US011409213B2

(12) United States Patent
Suzuki et al.

(10) Patent No.: US 11,409,213 B2
(45) Date of Patent: Aug. 9, 2022

(54) IMAGE FORMING APPARATUS AND HEATER CONTROL DEVICE

(71) Applicant: Canon Kabushiki Kaisha, Tokyo (JP)

(72) Inventors: Teruhiko Suzuki, Tokyo (JP); Naoki Ishikawa, Chiba (JP); Toshinori Kimura, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/151,896

(22) Filed: Jan. 19, 2021

(65) Prior Publication Data

US 2021/0223727 A1 Jul. 22, 2021

(30) Foreign Application Priority Data

Jan. 20, 2020 (JP) ..... JP2020-006854

(51) Int. Cl.

| | |
|---|---|
| ***G03G 15/20*** | (2006.01) |
| ***H05B 1/00*** | (2006.01) |
| ***H05B 3/00*** | (2006.01) |
| ***G03G 15/00*** | (2006.01) |
| ***H05B 47/21*** | (2020.01) |
| ***H05B 1/02*** | (2006.01) |

(52) U.S. Cl.

CPC ..... *G03G 15/2039* (2013.01); *G03G 15/80* (2013.01); *H05B 1/0241* (2013.01); *H05B 3/0066* (2013.01); *H05B 47/21* (2020.01)

(58) Field of Classification Search

CPC .. G03G 15/2039; G03G 15/205; G03G 15/80; H05B 1/0202; H05B 1/0241; H05B 3/0066; H05B 47/21

USPC ..... 399/67, 69, 70, 88, 90; 219/216, 483, 219/508

See application file for complete search history.

(56) References Cited

U.S. PATENT DOCUMENTS 5,229,577 A * 7/1993 Matsuura ..... B41J 29/38 219/497
6,711,361 B2 3/2004 Tanimoto
8,855,509 B2 * 10/2014 Fujiwara ..... G03G 15/2039 399/33

(Continued)

FOREIGN PATENT DOCUMENTS

JP 05089945 A * 4/1993
JP 2000010434 A 1/2000

(Continued)

*Primary Examiner* — Robert B Beatty
(74) *Attorney, Agent, or Firm* — Venable LLP

(57) ABSTRACT

An image forming apparatus includes an AC input portion to which AC power is to be supplied from a commercial power source, an image forming unit configured to form an image on a recording material, a fixing device including a first fixing heater and a second fixing heater which are configured to generate heat, the fixing device being configured to heat the image on the recording material by using the first fixing heater and the second fixing heater to fix the image to the recording material, a first relay configured to be switched between a first state in which electric connection is established and a second state in which electric connection is not established, and a second relay configured to be switched between a third state in which electric connection is established and a fourth state in which electric connection is not established.

9 Claims, 8 Drawing Sheets

(56) References Cited

U.S. PATENT DOCUMENTS

| | | | | |
|---|---|---|---|---|
| 2002/0012544 | A1* | 1/2002 | Yamane | G03G 15/205 399/69 |
| 2012/0000897 | A1* | 1/2012 | Shimura | G03G 15/2039 219/216 |
| 2015/0139678 | A1* | 5/2015 | Shimura | G03G 15/2039 399/69 |
| 2020/0341411 | A1* | 10/2020 | Kunimori | G03G 15/80 |

FOREIGN PATENT DOCUMENTS

| | | | | |
|---|---|---|---|---|
| JP | 2004287002 | A | * | 10/2004 |
| JP | 2008070560 | A | | 3/2008 |
| JP | 2016014769 | A | | 1/2016 |
| JP | 2019015810 | A | | 1/2019 |

* cited by examiner

IMAGE FORMING APPARATUS AND HEATER CONTROL DEVICE

BACKGROUND OF THE INVENTION

Field of the Invention

The present disclosure relates to an image forming apparatus including, inside a fixing device configured to fix an image to a recording material, a plurality of heaters (fixing heaters) configured to generate heat in fixing processing.

Description of the Related Art

Some electrophotographic image forming apparatuses include a fixing device configured to heat a toner image transferred to a recording material to melt and fix the toner image. A fixing device of this type may include a plurality of fixing heaters in order to ensure high productivity. In Japanese Patent Application Laid-open No. 2019-15810, there is disclosed an image forming apparatus in which power is supplied to a plurality of fixing heaters from one commercial power source. In Japanese Patent Application Laid-open No. 2016-14769, there is disclosed an electrophotographic image forming apparatus configured to use a plurality of commercial power sources to supply power to a plurality of fixing heaters in order to meet a demand for even higher productivity. With this type of fixing device of an image forming apparatus, because of the use of commercial power sources for heat generation operation, abnormal heat generation expected from a control error is required to be prevented. In Japanese Patent Application Laid-open No. 2016-14769, U.S. Pat. No. 6,711,361 (B2), and Japanese Patent Application Laid-open No. 2000-10434, there are disclosed configurations that shut off power supply from commercial power sources with the use of a relay for the prevention of abnormal heat generation.

Against this background, an image forming apparatus that includes a plurality of fixing heaters is required to include a relay in every power feeding path from a hot power feeding line (H) and neutral power feeding line (N) of a commercial power source. However, in a case where one relay is provided in every power feeding path, the configuration of a substrate increases by an amount corresponding to the area of the relay. For that reason, a relay having a plurality of contacts is used in Japanese Patent Application Laid-open No. 2008-70560 to save space.

An image forming apparatus of the related art that uses a relay having a plurality of contacts to adjust the temperature of the fixing device has a fear that the shutting off of power feeding to the fixing heaters may become impossible due to a failure in a drive circuit of the relay. In this case, power continues to be supplied to the fixing heaters, and abnormal heat generation consequently occurs in the fixing heaters. This is an issue that is directly linked to the safety of the image forming apparatus and, in a case where a control error of the fixing heaters occurs, it is therefore required to immediately shut off a power supply to the fixing heaters. The present disclosure has been made in view of the problem described above, and a main object of the present disclosure is therefore to provide an image forming apparatus capable of preventing abnormal heat generation of fixing heaters in the event of a failure of a relay having a plurality of contacts.

SUMMARY OF THE INVENTION

An image forming apparatus according to the present disclosure includes: an AC input portion to which AC power is to be supplied from a commercial power source; an image forming unit configured to form an image on a recording material; a fixing device including a first fixing heater and a second fixing heater which are configured to generate heat, the fixing device being configured to heat the image on the recording material by using the first fixing heater and the second fixing heater to fix the image to the recording material; a first relay configured to be switched between a first state in which electric connection is established and a second state in which electric connection is not established; and a second relay configured to be switched between a third state in which electric connection is established and a fourth state in which electric connection is not established, wherein the first fixing heater is connected to a first power feeding line for supplying the AC power from the AC input portion via the first relay, and is connected to a second power feeding line for supplying the AC power from the AC input portion via the second relay, and wherein the second fixing heater is connected to a third power feeding line for supplying the AC power from the AC input portion via the first relay, and is connected to a fourth power feeding line for supplying the AC power from the AC input portion via the second relay.

Further features of the present invention will become apparent from the following description of exemplary embodiments (with reference to the attached drawings).

DESCRIPTION OF THE EMBODIMENTS

Now, embodiments of the present disclosure are described with reference to the drawings.

First Embodiment

Figure 1:
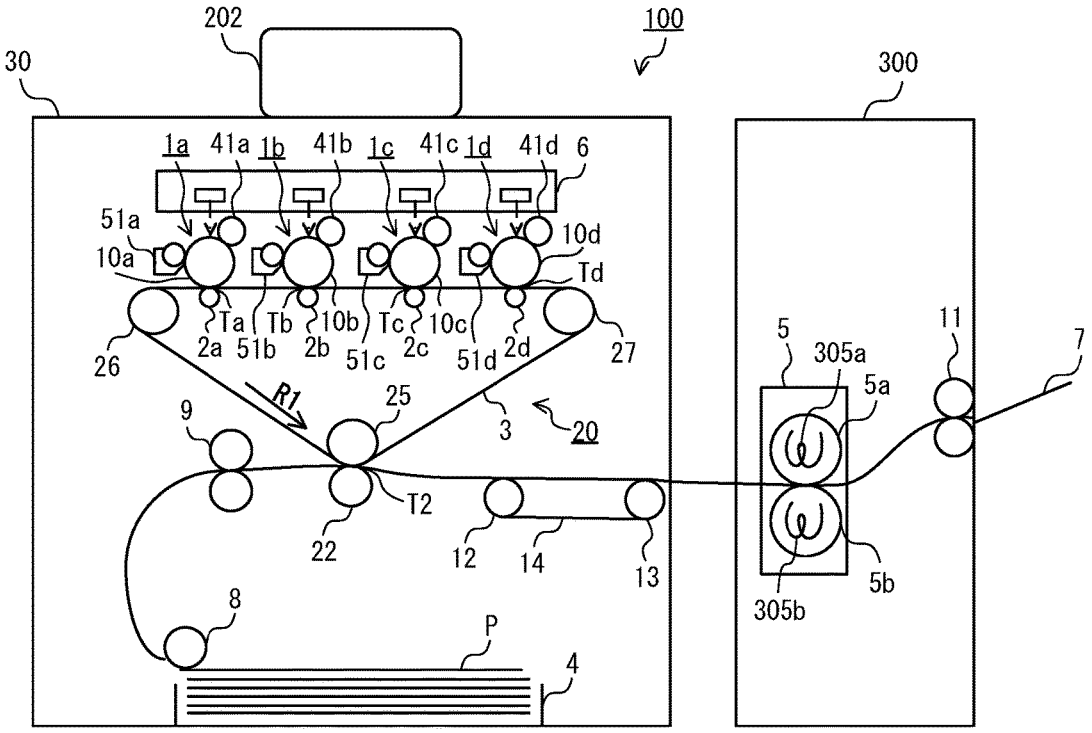
FIG. 1 is a diagram of a configuration of an image forming apparatus according to a first embodiment of the present disclosure.

FIG. 1 is a diagram of a configuration of an image forming apparatus according to a first embodiment of the present disclosure, which includes a heater control device. An image forming apparatus 100 has a configuration that includes a main body 30 and a fixing apparatus 300. The image forming apparatus 100 of the first embodiment is a tandem full-color printer of an intermediate transfer method. An operating unit 202 is provided above the main body 30. The main body 30 is configured to form a toner image (an image) on a recording material P. The fixing apparatus 300 is configured to obtain the recording material P on which the toner image has been formed from the main body 30, and fix the toner image to the recording material P.

The main body 30 includes image forming units 1*a*, 1*b*, 1*c*, and 1*d*, an exposure device 6, an intermediate transfer unit 20, a cassette-type container 4, and a conveyance mechanism for conveying the recording material P. The image forming units 1*a*, 1*b*, 1*c*, and 1*d* are aligned along an upper surface of an intermediate transfer belt 3 included in the intermediate transfer unit 20. Toner images formed in the respective image forming units 1*a*, 1*b*, 1*c*, and 1*d* are transferred onto the intermediate transfer belt 3.

The cassette-type container 4 contains the recording material P. The cassette-type container 4 can be pulled out of the main body 30 and, after a user replenishes the cassette-type container 4 with the recording material P, is set in the main body 30. The recording material P is fed from the cassette-type container 4 and conveyed by the conveyance mechanism along a conveyance path inside the main body 30. The conveyance mechanism includes a separation roller 8, registration rollers 9, and a discharge belt 14 along the conveyance path. The discharge belt 14 is supported by being hung on and stretched between a discharge roller 12 and a discharge roller 13. The separation roller 8 picks up the recording material P out of the cassette-type container 4 and separates one sheet of the recording material P from another sheet of the recording material P so that the recording material P is conveyed to the registration rollers 9 one sheet at a time. The registration rollers 9 stop rotating to wait for the recording material P conveyed from the separation roller 8. Skew feeding of the recording material P with respect to a conveying direction is corrected by a front end of the recording material P in the conveying direction being brought into contact with the stopped registration rollers 9 and thus forming a given amount of warping in the recording material P.

The image forming units 1*a*, 1*b*, 1*c*, and 1*d* have the same configuration, and differ from each other only in the color of a toner image to be formed. The image forming unit 1*a* is configured to form a black toner image. The image forming unit 1*b* is configured to form a cyan toner image. The image forming unit 1*c* is configured to form a magenta toner image. The image forming unit 1*d* is configured to form a yellow toner image. In the following description, "a", "b", "c", and "d" at the ends of the symbols are omitted in a case where discrimination between colors is not required for the description.

The image forming units 1 are replaceable units including photosensitive drums 10, chargers 41, and developing devices 51. The exposure device 6 is provided in the vicinity of the image forming units 1. The photosensitive drums 10 are each a drum-shaped photosensitive member with a photosensitive layer formed on a surface thereof. The photosensitive drums 10 are driven by a drive motor (not shown) to rotate clockwise in FIG. 1 at a given speed (a processing speed). The chargers 41 are configured to charge the photosensitive layers of the rotating photosensitive drums 10 to a uniform negative potential.

The exposure device 6 is configured to irradiate the charged photosensitive layer of each of the photosensitive drums 10 with a laser beam modulated based on scanning line image data, which is created by deploying a decomposed color image of the corresponding color. The exposure device 6 includes a rotating mirror built therein. The laser beam is reflected by the rotating mirror so that each of the photosensitive drums 10 is irradiated, to thereby scan each of the photosensitive drums 10 in a manner determined by the rotation of the rotating mirror. The scanning with the laser beam causes the photosensitive layer of each of the photosensitive drums 10 to form an electrostatic latent image. The developing devices 51 each develop the electrostatic latent image by adhering a toner of the corresponding color to the electrostatic latent image. A toner image is thus formed in the corresponding color on the surface of each of the photosensitive drums 10.

The surface of each of the photosensitive drums 10 can be brought into contact with the intermediate transfer belt 3. Primary transfer rollers 2*a*, 2*b*, 2*c*, and 2*d* are provided at positions that are opposed from photosensitive drums 10*a*, 10*b*, 10*c*, and 10*d*, respectively, with the intermediate transfer belt 3 sandwiched therebetween. The primary transfer rollers 2 bring the photosensitive drums 10 into contact with the intermediate transfer belt 3 by pressing the intermediate transfer belt 3 toward the photosensitive drums 10, to form primary transfer areas T. A positive direct-current voltage is applied to the primary transfer rollers 2, to thereby transfer negative toner images borne on the photosensitive drums 10 onto the intermediate transfer belt 3 passing through the primary transfer areas T. Toner images are transferred from the photosensitive drums 10*a*, 10*b*, 10*c*, and 10*d* on top of one another, to thereby form a full-color toner image on the intermediate transfer belt 3.

The intermediate transfer unit 20 is a replaceable unit that can be detached as one from the main body 30 to be replaced. The intermediate transfer unit 20 includes a support mechanism for supporting the intermediate transfer belt 3 and a drive mechanism for driving the intermediate transfer belt 3. The intermediate transfer belt 3 is a non-stretching belt member without ends. The intermediate transfer belt 3 is hung on and stretched between a tension roller 27, which is the support mechanism, a belt driving roller 26, and a secondary transfer inner roller 25 to be supported. The belt driving roller 26 is driven to be rotated by a drive mechanism (not shown), and thus rotates the intermediate transfer belt 3 in a direction indicated by an arrow R1.

A secondary transfer outer roller 22 is provided at a position that is opposed to the secondary transfer inner roller 25 with the intermediate transfer belt 3 sandwiched therebetween. The secondary transfer inner roller 25 and the secondary transfer outer roller 22 form a secondary transfer area T2. The secondary transfer inner roller 25 is assembled into the intermediate transfer unit 20, and the secondary transfer outer roller 22 is assembled into the main body 30. The intermediate transfer belt 3 is suspended by the secondary transfer inner roller 25 in the secondary transfer area T2. A positive direct-current voltage is applied to the secondary transfer outer roller 22 from a power source (not shown), to thereby generate a transfer electric field for transferring the toner image between the secondary transfer outer roller 22 and the secondary transfer inner roller 25 connected to a ground potential.

The intermediate transfer belt 3 is driven by the belt driving roller 26, to thereby convey the toner image transferred from the image forming units 1 to the secondary transfer area T2. The registration rollers 9 convey the recording material P to the secondary transfer area T2 in time with the conveyance of the toner image to the secondary transfer area T2. The toner image borne on the intermediate transfer belt 3 is transferred by the action of the transfer electric field to the recording material P. In this manner, a toner image is formed on the recording material P. The recording material P with the toner image formed thereon is conveyed on the discharge belt 14 to be handed over to the fixing apparatus 300.

The fixing apparatus 300 includes a fixing device 5 and delivery rollers 11, and is configured to fix the toner image to the recording material P. The fixing device 5 includes a fixing roller 5*a* and a pressure roller 5*b*. A heating nip is formed by pressing the pressure roller 5*b* against the fixing roller 5*a*. The fixing roller 5*a* contains a fixing heater 305*a*. The pressure roller 5*b* contains a fixing heater 305*b*. The recording material P is heated by the fixing roller 5*a* and the pressure roller 5*b* in the process of being nipped and conveyed through the heating nip, and the toner image is consequently melted and fixed to a surface of the recording material P under pressure. The recording material P with the image fixed thereto is delivered by the delivery rollers 11 from the fixing device 5 to a delivery tray 7.

The operating unit 202 is a user interface, and includes an input interface and an output interface. The input interface is various key buttons, a touch panel, and the like. The output interface is a display, a speaker, and the like. Execution of processing of forming an image on the recording material P is started by a user by inputting an instruction to form an image through the input interface of the operating unit 202. The output interface of the operating unit 202 can notify the user of the state of the image forming apparatus 100 (the main body 30 and the fixing apparatus 300), for example, the number of sheets on which an image is formed, information about whether an image is being formed, occurrence of a jam, the location of the jam, and the like. The output interface of the operating unit 202 also displays, for a service person, on a screen, a factor leading to malfunction, guidance on initialization operation in the installation of the main body and in the replacement of the developing device, and a screen for receiving an instruction to start operation, in order to improve the efficiency of service work of the service person.

<System Configuration>

Figure 2:
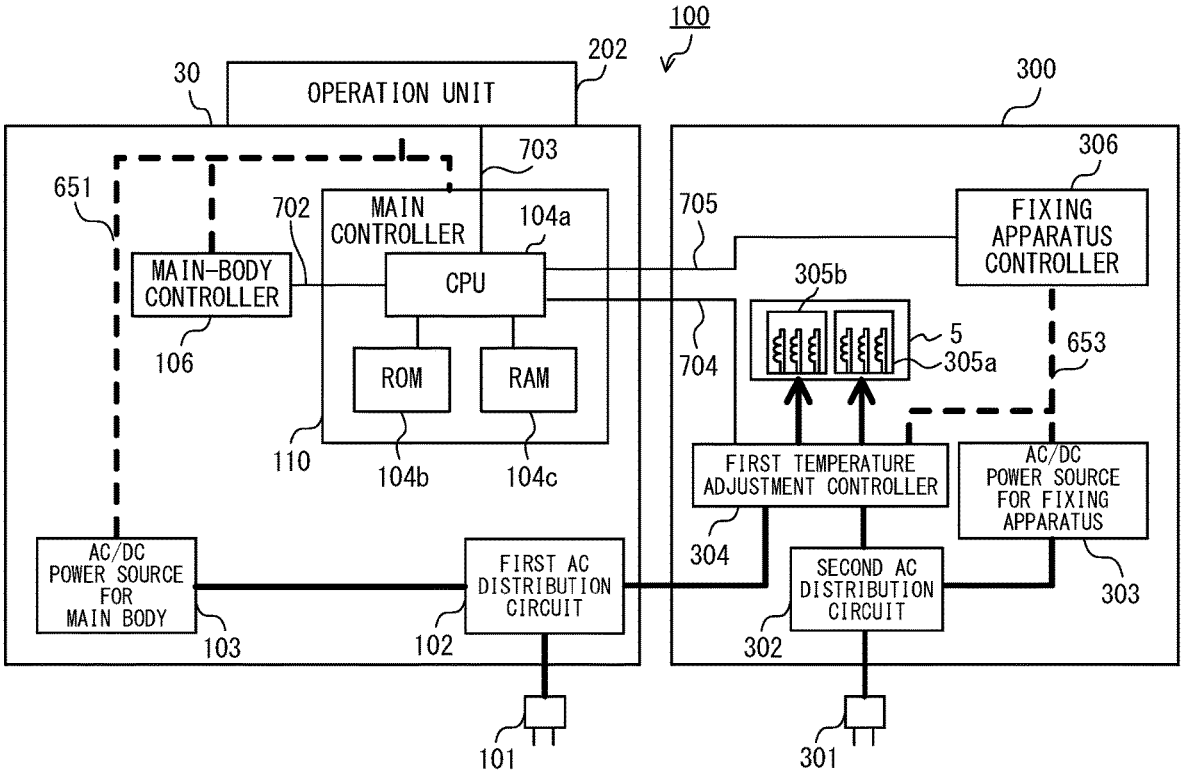
FIG. 2 is an explanatory diagram of a system configuration in the first embodiment.

FIG. 2 is an explanatory diagram of a system configuration of the image forming apparatus 100. Each thick solid line represents a power feeding path (power feeding line) of AC power fed from a commercial power source. Each thick broken line represents a power feeding path (power feeding line) of DC power generated from the AC power. Each thin line represents a signal line along which a signal is transmitted. The symbols "AC" and "DC" indicate alternating current and direct current, respectively.

In the image forming apparatus 100, the main body 30 is connected to the commercial power source via a first AC input portion (a plug and a cord) 101. The fixing apparatus 300 is connected to the commercial power source via a second AC input portion (a plug and a cord) 301. The first AC input portion 101 and the second AC input portion 301 in the drawing each have one power line for the purpose of simplifying the description, but the number of power lines is not limited thereto.

A first AC distribution circuit 102, an AC/DC power source 103 for the main body, a main-body controller 106, and a main controller 110 are provided inside the main body 30. The fixing apparatus 300 is provided with, in addition to the fixing device 5, a second AC distribution circuit 302, an AC/DC power source 303 for the fixing apparatus, a first temperature adjustment controller 304, and a fixing apparatus controller 306.

The commercial power source supplies AC power to the first AC distribution circuit 102 via the first AC input portion 101. The first AC distribution circuit 102 distributes the supplied AC power between the AC/DC power source 103 for the main body and the first temperature adjustment controller 304 of the fixing apparatus 300. The AC/DC power source 103 for the main body converts the supplied AC power into DC power to be used in the main body 30, and distributes the DC power among the main controller 110, the main-body controller 106, the operating unit 202, and others through a power feeding line 651. Although not shown, the AC/DC power source 103 for the main body supplies power to DC loads, which are a sensor, a motor, and the like, as well.

The main controller 110 includes a central processing unit (CPU) 104*a*, a read-only memory (ROM) 104*b*, and a random access memory (RAM) 104*c*. The CPU 104*a* controls, in an integrated manner, the overall operation of the image forming apparatus 100 (the main body 30 and the fixing apparatus 300) by executing a computer program that is stored in the ROM 104*b*. The RAM 104*c* provides a temporary storage area used in a case where the CPU 104*a* executes processing. The RAM 104*c* stores, for example, a set value of a high voltage to be applied in image forming, various types of data, and image forming command information from the operating unit 202. The RAM 104*c* is configured so as to be able to keep data even when the image forming apparatus 100 is powered off, with the use of a battery (not shown) or the like.

The CPU 104*a* holds communication to and from the main-body controller 106 through a signal line 702. The CPU 104*a* controls the operation of the main body 30 by holding communication to and from the main-body controller 106 through the signal line 702. The CPU 104*a* holds communication to and from the operating unit 202 through a signal line 703. The CPU 104*a* controls input to and output from the user interface by holding communication to and from the operating unit 202 through the signal line 703. The CPU 104*a* holds communication to and from the first temperature adjustment controller 304 through a signal line 704. The CPU 104*a* adjusts and controls the temperature of the fixing device 5 (a fixing temperature) by holding communication to and from the first temperature adjustment controller 304 through the signal line 704. The CPU 104*a* holds communication to and from the fixing apparatus controller 306 through a signal line 705. The CPU 104*a* controls the operation of the fixing apparatus 300 by holding communication to and from the fixing apparatus controller 306 through the signal line 705.

The main-body controller 106 includes, for example, an application-specific integrated circuit (ASIC), and a motor, a solenoid, a clutch, and other loads (not shown) provided in the main body 30 as well as sensors and similar components (not shown) provided in the main body 30 are connected to the main-body controller 106. The main-body controller 106 is configured to drive the loads in the main body 30, obtain information from the sensors and similar components in the main body 30, and perform image forming control (for example, high-voltage output control and control of lighting of the exposure device 6), based on an instruction obtained from the main controller 110 through the signal line 702. The loads and the sensors and similar components are supplied with DC power via the main-body controller 106.

The commercial power source supplies AC power to the second AC distribution circuit 302 via the second AC input portion 301. The second AC distribution circuit 302 distributes the supplied AC power between the first temperature adjustment controller 304 and the AC/DC power source 303 for the fixing apparatus. The AC/DC power source 303 for the fixing apparatus converts the supplied AC power into DC power to be used in the fixing apparatus 300, and distributes the DC power between the first temperature adjustment controller 304 and the fixing apparatus controller 306 through a power feeding line 653.

The first temperature adjustment controller 304 is configured to control the supply of AC power to the fixing heaters 305*a* and 305*b* of the fixing device 5, based on an instruction obtained from the main controller 110 through the signal line 704. The fixing temperature for fixing a toner image to the recording material P can appropriately be adjusted through the control of the supply of AC power to the fixing heaters 305*a* and 305*b*. The first temperature adjustment controller 304 in the first embodiment supplies the AC power that is supplied from the first AC distribution circuit 102 to the fixing heater 305*b*, and supplies the AC power that is supplied from the second AC distribution circuit 302 to the fixing heater 305*a*. In short, the two fixing heaters 305*a* and 305*b* of the fixing device 5 are supplied with AC power from different power source systems.

The fixing roller 5*a* and the pressure roller 5*b* are provided with thermistors or other temperature detection devices (not shown) for detecting the temperatures of the fixing heaters 305*a* and 305*b*. The main controller 110 controls the fixing temperature by controlling the supply of AC power to the fixing heaters 305*a* and 305*b* by the first temperature adjustment controller 304, based on detection results provided from the temperature detection devices.

The fixing apparatus controller 306 includes, for example, an ASIC, and a motor, a solenoid, a clutch, and other loads (not shown) provided in the fixing apparatus 300 as well as sensors and similar components (not shown) provided in the fixing apparatus 300 are connected to the fixing apparatus controller 306. The fixing apparatus controller 306 is configured to drive the loads in the fixing apparatus 300 and obtain information from the sensors and similar components in the fixing apparatus 300, based on an instruction obtained from the main controller 110 through the signal line 705. The loads and the sensors and similar components are supplied with DC power via the fixing apparatus controller 306.

<First Temperature Adjustment Controller>

Figure 3:
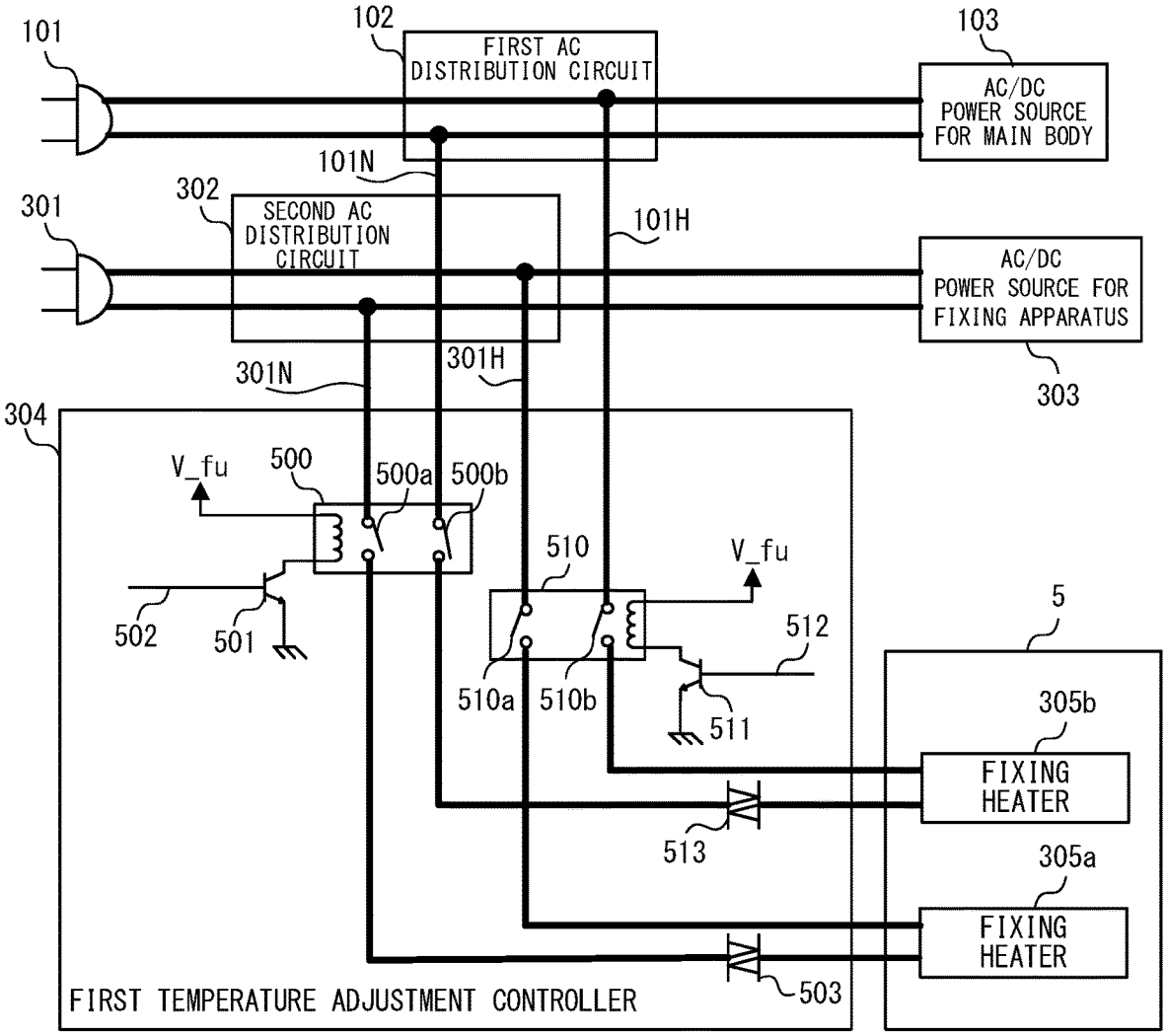
FIG. 3 is an explanatory diagram of a configuration of a first temperature adjustment controller.

FIG. 3 is an explanatory diagram of a configuration of the first temperature adjustment controller 304. The first temperature adjustment controller 304 includes a first relay 500, a second relay 510, a first transistor 501, a second transistor 511, and triacs 503 and 513. The first relay 500 and the second relay 510 are each a relay including a plurality of movable contacts (two contacts in the first embodiment). The first relay 500 and the second relay 510 are used to feed AC power to the fixing heaters 305*a* and 305*b* and forcibly shut off the power feeding. The first temperature adjustment controller 304 is connected to a hot power feeding line 101H and neutral power feeding line 101N of the first AC input portion 101 via the first AC distribution circuit 102. The first temperature adjustment controller 304 is connected to a hot power feeding line 301H and neutral power feeding line 301N of the second AC input portion 301 via the second AC distribution circuit 302. The hot power feeding lines 101H and 301H are power feeding lines to be connected to a hot terminal of the commercial power source. The neutral power feeding lines 101N and 301N are power feeding lines to be connected to a neutral terminal of the commercial power source. The first transistor 501 is a drive circuit configured to supply a drive current to the first relay 500. The second transistor 511 is a drive circuit configured to supply a drive current to the second relay 510.

A first contact 500*a* of the first relay 500 is connected at one end to the neutral power feeding line 301N. Another end of the first contact 500*a* of the first relay 500 is connected to the fixing heater 305*a*. A second contact 500*b* of the first relay 500 is connected at one end to the neutral power feeding line 101N. Another end of the second contact 500*b* of the first relay 500 is connected to the fixing heater 305*b*. Application of DC power (DC voltage V_fu) supplied from the power feeding line 653 to the first relay 500 is controlled by establishing electric connection in the first transistor 501. With the establishment of electric connection in the first transistor 501, the DC voltage V_fu is applied and a current (drive current) accordingly flows into the first transistor 501. The first contact 500*a* and the second contact 500*b* are thus connected by an electromagnet inside the first relay 500, and electric connection is accordingly established in the first relay 500. In a case where the current flow to the first transistor 501 stops, the first contact 500*a* and the second contact 500*b* are disconnected and the first relay 500 is consequently shut off. The establishment of electric connection in the first transistor 501 and shutting off of the first transistor 501 are controlled with a control signal 502 from the first temperature adjustment controller 304. A state indicated by the control signal 502 is determined by an instruction of the CPU 104*a*. In this manner, the first transistor 501 functions as a connection control circuit configured to control the connection state of the first relay 500.

A first contact 510*a* of the second relay 510 is connected at one end to the hot power feeding line 301H. Another end of the first contact 510*a* of the second relay 510 is connected to the fixing heater 305*a*. A second contact 510*b* of the second relay 510 is connected at one end to the hot power feeding line 101H. Another end of the second contact 510*b* of the second relay 510 is connected to the fixing heater 305*b*. Application of DC power (DC voltage V_fu) supplied from the power feeding line 653 to the second relay 510 is controlled by establishing electric connection in the second transistor 511. With the establishment of electric connection in the second transistor 511, the DC voltage V_fu is applied and a current (drive current) accordingly flows into the second transistor 511. The first contact 510*a* and the second contact 510*b* are thus connected by an electromagnet inside the second relay 510, and electric connection is accordingly established in the second relay 510. In a case where the current flow to the second transistor 511 stops, the first contact 510*a* and the second contact 510*b* are disconnected and the second relay 510 is consequently shut off. The establishment of electric connection in the second transistor 511 and shutting off of the second transistor 511 are controlled with a control signal 512 from the first temperature adjustment controller 304. A state indicated by the control signal 512 is determined by an instruction of the CPU 104*a*. In this manner, the second transistor 511 functions as a connection control circuit configured to control the connection state of the second relay 510.

The fixing heater 305*a* of the fixing device 5 is connected to the hot power feeding line 301H via the first contact 510*a* inside the first temperature adjustment controller 304. The fixing heater 305*a* is connected to the neutral power feeding line 301N via the first contact 500*a* and the triac 503 inside the first temperature adjustment controller 304. The triac 503 is controlled with a control signal input from the first temperature adjustment controller 304. A state indicated by this control signal is determined by an instruction of the CPU 104*a*. The supply of AC power to the fixing heater 305*a* is controlled by the triac 503, and the temperature of the fixing device 5 is adjusted accordingly.

The fixing heater 305*b* of the fixing device 5 is connected to the hot power feeding line 101H via the second contact 510*b* inside the first temperature adjustment controller 304. The fixing heater 305*b* is connected to the neutral power feeding line 101N via the second contact 500*b* and the triac 513 inside the first temperature adjustment controller 304. The triac 513 is controlled with a control signal input from the first temperature adjustment controller 304. A state indicated by this control signal is determined by an instruction of the CPU 104*a*. The supply of AC power to the fixing heater 305*b* is controlled by the triac 513, and the temperature of the fixing device 5 is adjusted accordingly.

The first temperature adjustment controller 304 which has the configuration described above can prevent abnormal heat generation of the fixing device 5 by disconnecting the first relay 500 and the second relay 510 in a case where temperature adjustment control by the triacs 503 and 513 is not working.

In a case where temperature adjustment control by the triac 503 is not working and a short circuit between an emitter and a collector occurs in the first transistor 501, the first temperature adjustment controller 304 disconnects (opens) the first contact 510*a* of the second relay 510 with the control signal 512. The first temperature adjustment controller 304 shuts off the supply of AC power to the fixing heater 305*a* in this manner.

In a case where temperature adjustment control by the triac 503 is not working and a short circuit between an emitter and a collector occurs in the second transistor 511, the first temperature adjustment controller 304 disconnects (opens) the first contact 500*a* of the first relay 500 with the control signal 502. The first temperature adjustment controller 304 shuts off the supply of AC power to the fixing heater 305*a* in this manner.

In a case where temperature adjustment control by the triac 513 is not working and a short circuit between the emitter and the collector occurs in the second transistor 511, the first temperature adjustment controller 304 disconnects (opens) the second contact 500*b* of the first relay 500 with the control signal 502. The first temperature adjustment controller 304 shuts off the supply of AC power to the fixing heater 305*b* in this manner.

In a case where temperature adjustment control by the triac 513 is not working and a short circuit between the emitter and the collector occurs in the first transistor 501, the first temperature adjustment controller 304 disconnects (opens) the second contact 510*b* of the second relay 510 with the control signal 512. The first temperature adjustment controller 304 shuts off the supply of AC power to the fixing heater 305*b* in this manner.

Figure 4:
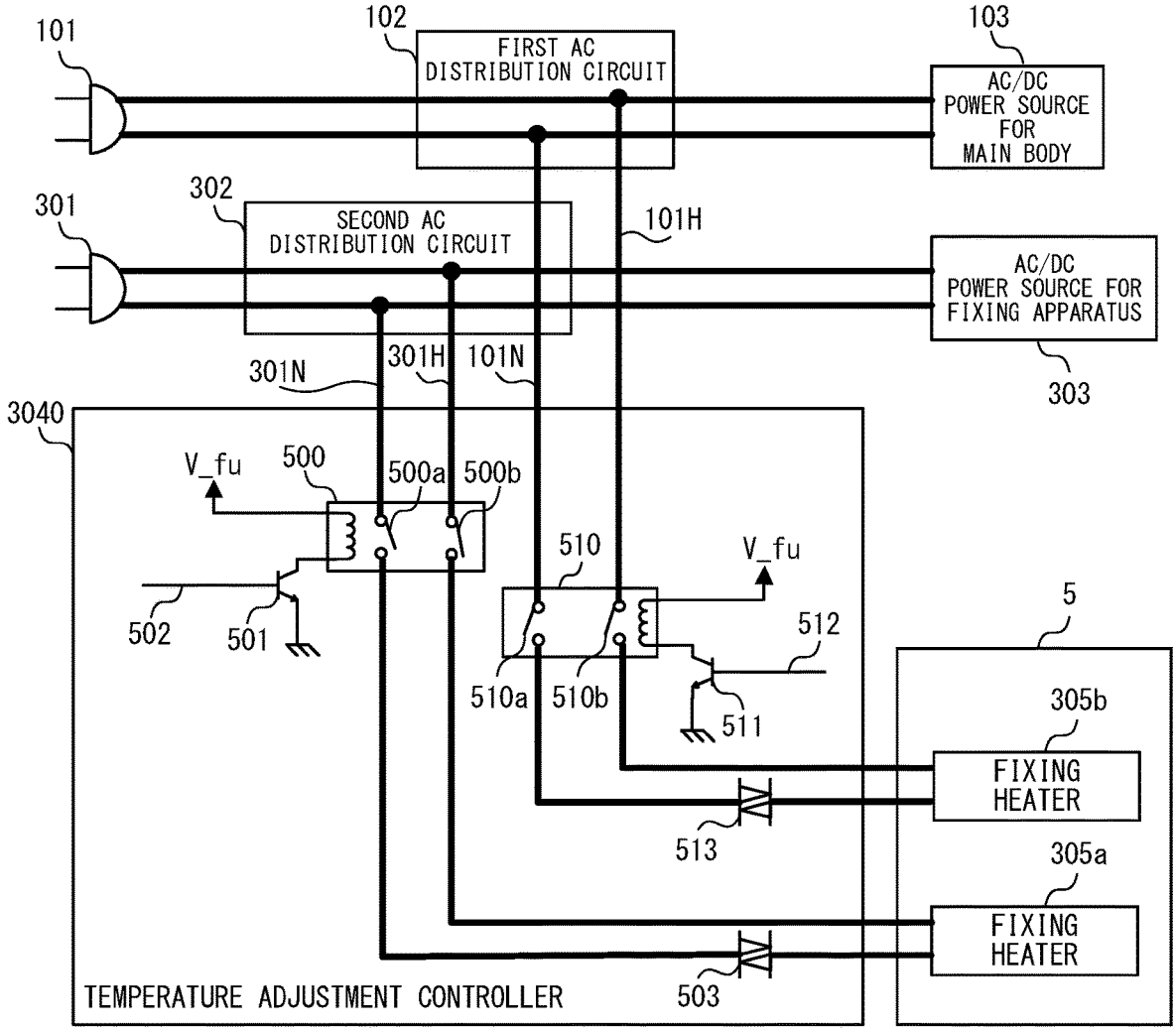
FIG. 4 is an explanatory diagram of a configuration of a temperature adjustment controller according to the related art.

Effects of the first temperature adjustment controller 304 in the first embodiment are described with reference to a temperature adjustment controller in the related art that is illustrated in FIG. 4. A temperature adjustment controller 3040 of FIG. 4 has the same internal configuration as that of the first temperature adjustment controller 304, but differs from the first temperature adjustment controller 304 in which polarity of AC power is connected to which contact out of the contacts of the first relay 500 and the second relay 510. Specifically, in the temperature adjustment controller 3040, the first contact 500*a* of the first relay 500 is connected at one end to the neutral power feeding line 301N. Another end of the first contact 500*a* of the first relay 500 is connected to the fixing heater 305*a*. The second contact 500*b* of the first relay 500 is connected at one end to the hot power feeding line 301H. Another end of the second contact 500*b* of the first relay 500 is connected to the fixing heater 305*a*. The first contact 510*a* of the second relay 510 is connected at one end to the neutral power feeding line 101N. Another end of the first contact 510*a* of the second relay 510 is connected to the fixing heater 305*b*. The second contact 510*b* of the second relay 510 is connected at one end to the hot power feeding line 101H. Another end of the second contact 510*b* of the second relay 510 is connected to the fixing heater 305*b*.

With the contacts connected in this manner, in a case where, for example, temperature adjustment control by the triac 503 is not working and a short circuit between the emitter and the collector occurs in the first transistor 501, the contacts of the first relay 500 are connected irrespective of what control is performed by the temperature adjustment controller 3040. Consequently, AC power supplied to the fixing heater 305*a* cannot be shut off and abnormal heat generation occurs. Similarly, in a case where temperature adjustment control by the triac 513 is not working and a short circuit between the emitter and the collector occurs in the second transistor 511, AC power supplied to the fixing heater 305*b* cannot be shut off and abnormal heat generation occurs as a result.

It is thus difficult in the temperature adjustment controller 3040 in the related art to prevent abnormal heat generation of the fixing heaters 305*a* and 305*b* when there is a trouble in the triac 503 and the first relay 500, or when there is a trouble in the triac 513 and the second relay 510.

In contrast, the first temperature adjustment controller 304 in the first embodiment can shut off the supply of AC power to the fixing heaters 305*a* and 305*b* when there is a trouble in the triac 503 and the first relay 500, or when there is a trouble in the triac 513 and the second relay 510. Abnormal heat generation of the fixing heaters 305*a* and 305*b* can be prevented by the shutoff of the supply of AC power. Reliability with regards to shutoff of AC power supply in case of a trouble is therefore higher in the first temperature adjustment controller 304 in the first embodiment than in the temperature adjustment controller 3040 in the related art.

In regulations set down about image forming apparatus by the International Electrotechnical Commission (IEC), relays are defined as a shutoff part for shutting off power to an AC load that involves heat generation, but triacs are not defined as the part. This implies that relays are a part that satisfies standards as a shutoff part, namely, that the reliability of relays as a shutoff part is higher than that of triacs.

<Image Forming Processing>

Figure 5A:
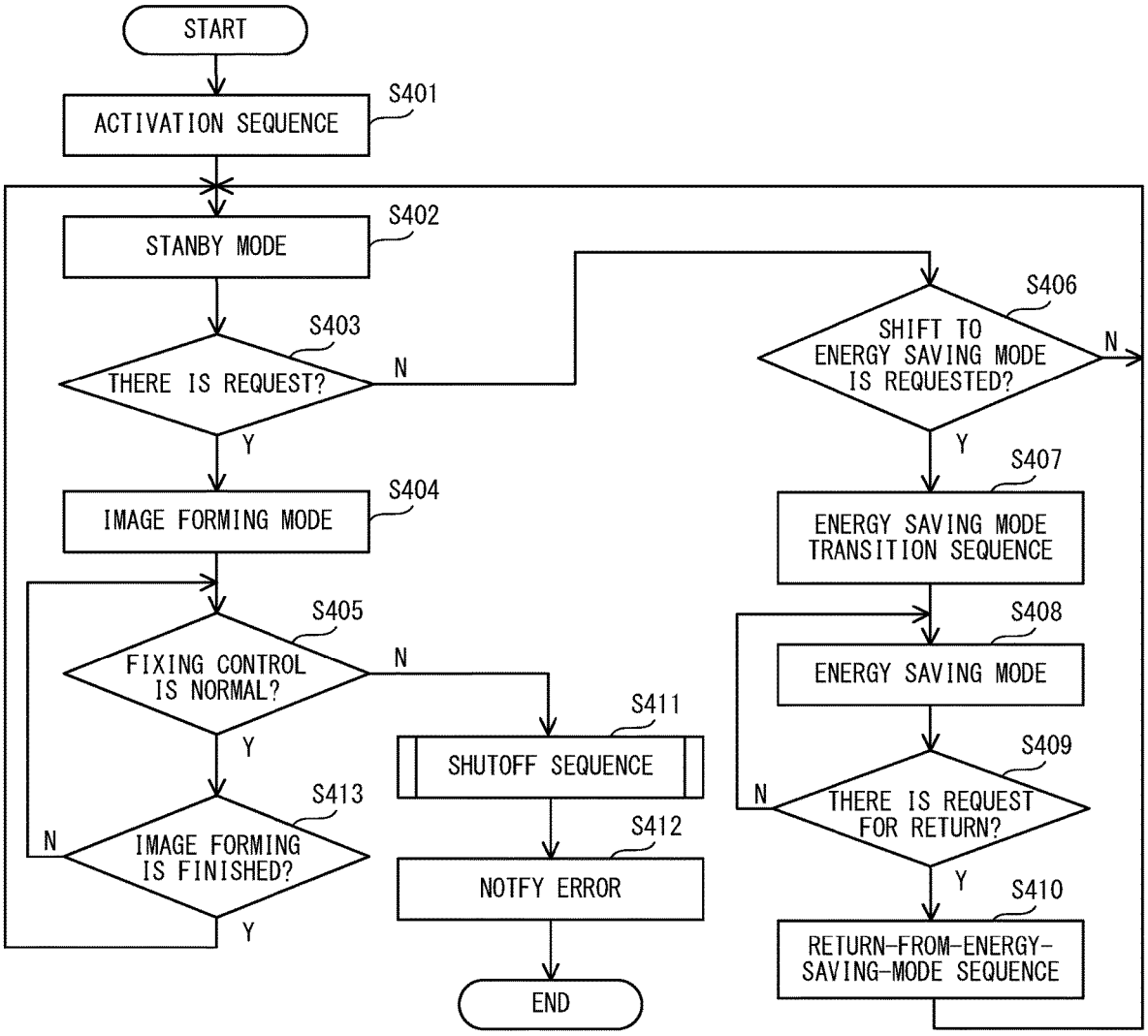
FIG. 5A and FIG. 5B are flow charts for illustrating image forming processing.
Figure 5B:
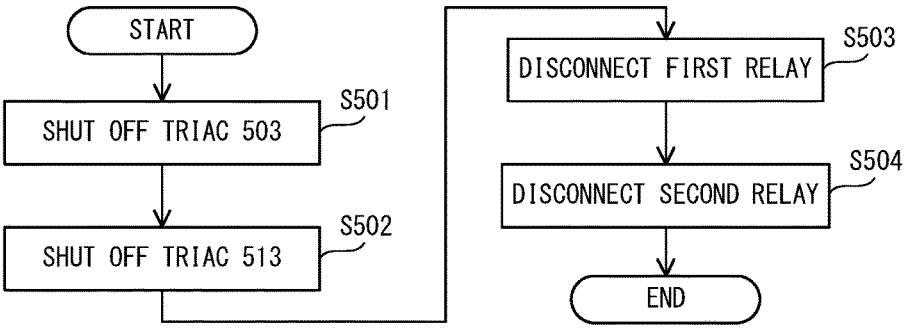

FIG. 5A and FIG. 5B are flow charts for illustrating image forming processing in the first embodiment. FIG. 5A is a flow chart of overall image forming processing. The image forming apparatus 100 starts this processing in a case where a power switch (not shown) is operated to start supply of AC power from the commercial power source.

With the start of the feeding of AC power, the AC/DC power source 103 for the main body and the AC/DC power source 303 for the fixing apparatus are activated. The CPU 104*a* starts operating when supplied with DC power from the AC/DC power source 103 for the main body, and executes an activation sequence in which the state of the image forming apparatus 100 is checked and various types of processing including various adjustments are executed (Step S401). The fixing apparatus 300 connects the contacts of the first relay 500 and the second relay 510 in the activation sequence. In a case where the activation sequence is finished, the CPU 104*a* sets the operation mode of the image forming apparatus 100 to a standby mode (Step S402). In the standby mode, the CPU 104*a* determines whether an image forming request has been obtained from the operating unit 202 or an external apparatus (Step S403).

When there is an image forming request that has been obtained (Step S403: Y), the CPU 104*a* sets the operation mode of the image forming apparatus to an image forming mode, and executes the image forming processing by controlling the operation of the main-body controller 106 and the fixing apparatus controller 306 (Step S404). The CPU 104*a* monitors the fixing temperature of the fixing device 5 in the image forming processing, based on detection results provided by the temperature detection devices, to determine whether fixing control is being performed normally (Step S405). The CPU 104*a* keeps executing the determination about fixing control until the image forming processing is ended (Step S405: Y, Step S413: N). In a case where the fixing control continues to be executed normally until the end of the image forming processing (Step S405: Y, Step S413: Y), the CPU 104*a* sets the operation mode of the image forming apparatus 100 back to the standby mode.

In a case where it is determined that something is wrong with the fixing control (Step S405: N), the CPU 104*a* executes a shutoff sequence for shutting off AC power to the fixing device 5 (Step S411). After the shutoff sequence, the CPU 104*a* uses the operating unit 202 to notify an error indicating that something has gone wrong with the fixing control (Step S412). The CPU 104*a* stops the operation of the image forming apparatus 100 as an action to be taken in an error mode.

When there is no image forming request that has been obtained (Step S403: N), the CPU 104*a* determines whether there has been a request to shift to an energy saving mode, in which power consumption is smaller than in the standby mode (Step S406). Whether there has been a request to shift to the energy saving mode is determined from, for example, whether a power mode switching switch (not shown) provided in the operating unit 202 has been operated, or absence of an image forming request for a given length of time. When there has been no request to shift to the energy saving mode (Step S406: N), the CPU 104*a* waits for an image forming request in the standby mode.

When there has been a request to shift to the energy saving mode (Step S406: Y), the CPU 104*a* executes an energy saving mode transition sequence (Step S407). In the energy saving mode transition sequence, the contacts of the first relay 500 and the second relay 510 in the fixing device 5 are disconnected. In a case where the energy saving mode transition sequence is finished, the CPU 104*a* sets the operation state of the image forming apparatus 100 to the energy saving mode (Step S408). In the energy saving mode, the CPU 104*a* determines whether a request to return from the energy saving mode has been obtained (Step S409). The request to return from the energy saving mode is input to the CPU 104*a* through, for example, operation on the power mode switching switch (not shown) provided in the operating unit 202, or through input of an image forming job.

When there is a request to return from the energy saving mode that has been obtained (Step S409: Y), the CPU 104*a* executes a return-from-energy-saving-mode sequence (Step S410). After the return-from-energy-saving-mode sequence is finished, the CPU 104*a* sets the operation mode of the image forming apparatus 100 back to the standby mode.

FIG. 5B is a flow chart for illustrating the processing of the AC power shutoff sequence of Step S411. This processing is executed by the transmission of a control signal from the CPU 104*a* to the first temperature adjustment controller 304 through the signal line 704.

The CPU 104*a* shuts off the triac 503 of the first temperature adjustment controller 304 (Step S501), and shuts off the triac 513 (Step S502). Next, the CPU 104*a* disconnects the contacts of the first relay 500 (Step S503), and disconnects the contacts of the second relay 510 (Step S504). This shuts off the feeding of AC power to the fixing heaters 305*a* and 305*b* along both of the hot power feeding lines and the neutral power feeding lines. The order of shutting off the triacs 503 and 513 and the order of disconnecting the first relay 500 and the second relay 510 may be reversed.

Second Embodiment

Figure 6:
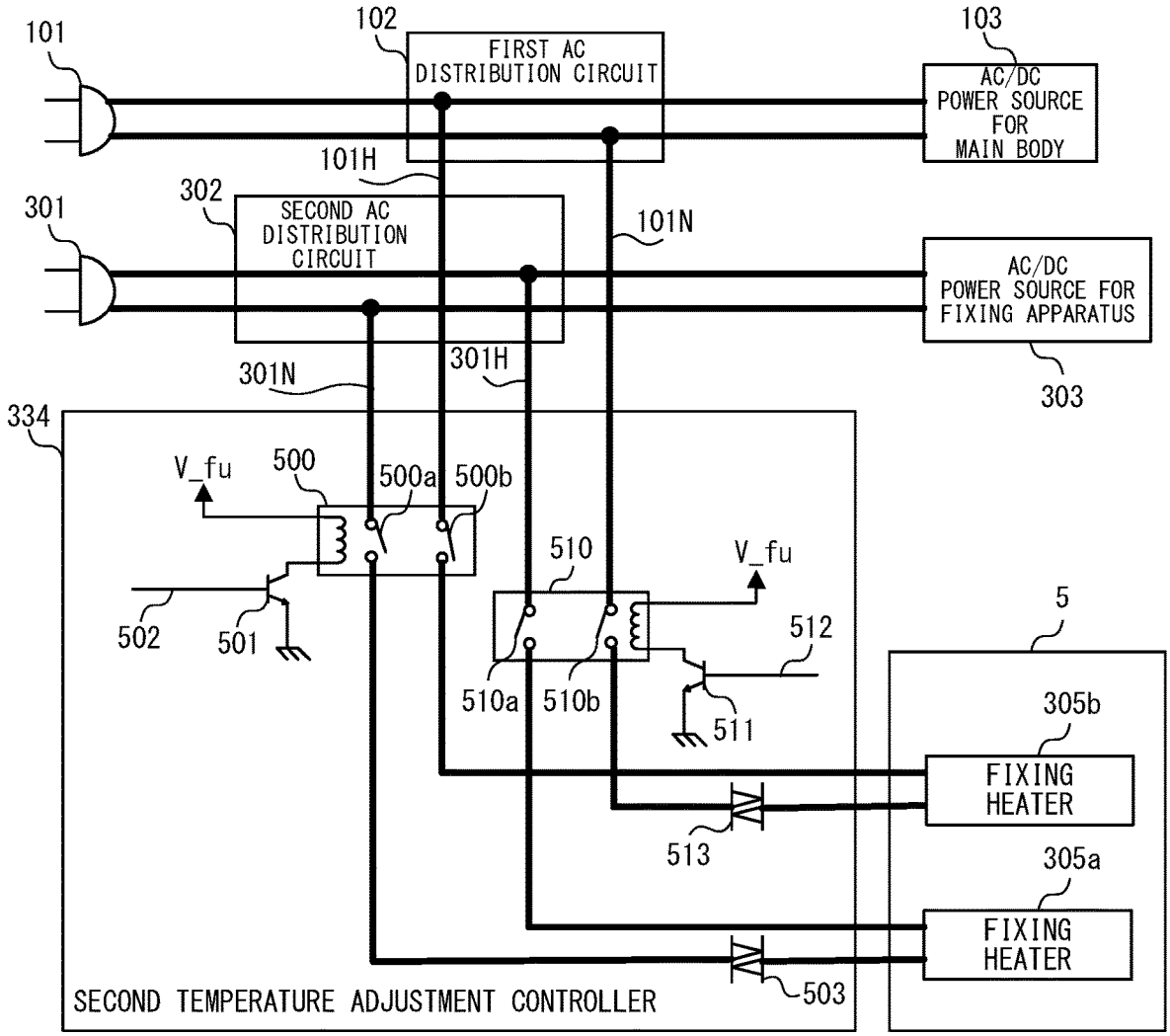
FIG. 6 is an explanatory diagram of a configuration of a second temperature adjustment controller.

In a second embodiment of the present disclosure, a second temperature adjustment controller is used in place of the first temperature adjustment controller 304. The rest of the configuration of the second embodiment (the configuration of the image forming apparatus 100 and the system configuration) is the same as that of the first embodiment illustrated in FIG. 1 and FIG. 2. Processing executed in image forming (FIG. 5A and FIG. 5B) in the second embodiment is also the same as the one in the first embodiment. FIG. 6 is an explanatory diagram of a configuration of a second temperature adjustment controller 334. The difference from the first temperature adjustment controller 304 illustrated in FIG. 3 is described.

The first contact 500*a* of the first relay 500 is connected at one end to the neutral power feeding line 301N. Another end of the first contact 500*a* of the first relay 500 is connected to the fixing heater 305*a*. The second contact 500*b* of the first relay 500 is connected at one end to the hot power feeding line 101H. Another end of the second contact 500*b* of the first relay 500 is connected to the fixing heater 305*b*. The first contact 510*a* of the second relay 510 is connected at one end to the hot power feeding line 301H. Another end of the first contact 510*a* of the second relay 510 is connected to the fixing heater 305*a*. The second contact 510*b* of the second relay 510 is connected at one end to the neutral power feeding line 101N. Another end of the second contact 510*b* of the second relay 510 is connected to the fixing heater 305*b*. The operation principle of the first relay 500 and the second relay 510 is the same as that of the first relay 500 and the second relay 510 of the first temperature adjustment controller 304.

The fixing heater 305*a* of the fixing device 5 is connected to the hot power feeding line 301H via the first contact 510*a* inside the second temperature adjustment controller 334. The fixing heater 305*a* is connected to the neutral power feeding line 301N via the first contact 500*a* and the triac 503 inside the second temperature adjustment controller 334. The fixing heater 305*b* of the fixing device 5 is connected to the hot power feeding line 101H via the second contact 500*b* inside the second temperature adjustment controller 334. The fixing heater 305*b* is connected to the neutral power feeding line 101N via the second contact 510*b* and the triac 513 inside the second temperature adjustment controller 334.

The same effects as those of the first temperature adjustment controller 304 are obtained even when the second temperature adjustment controller 334 having the configuration described above is used.

In a case where temperature adjustment control by the triac 503 is not working and a short circuit between the emitter and the collector occurs in the first transistor 501, the second temperature adjustment controller 334 disconnects the first contact 510*a* of the second relay 510 with the control signal 512. The second temperature adjustment controller 334 shuts off the supply of AC power to the fixing heater 305*a* in this manner.

In a case where temperature adjustment control by the triac 503 is not working and a short circuit between the emitter and the collector occurs in the second transistor 511, the second temperature adjustment controller 334 disconnects the first contact 500*a* of the first relay 500 with the control signal 502. The second temperature adjustment controller 334 shuts off the supply of AC power to the fixing heater 305*a* in this manner.

In a case where temperature adjustment control by the triac 513 is not working and a short circuit between the emitter and the collector occurs in the second transistor 511, the second temperature adjustment controller 334 disconnects the second contact 500*b* of the first relay 500 with the control signal 502. The second temperature adjustment controller 334 shuts off the supply of AC power to the fixing heater 305*b* in this manner.

In a case where temperature adjustment control by the triac 513 is not working and a short circuit between the emitter and the collector occurs in the first transistor 501, the second temperature adjustment controller 334 disconnects the second contact 510*b* of the second relay 510 with the control signal 512. The second temperature adjustment controller 334 shuts off the supply of AC power to the fixing heater 305*b* in this manner.

Third Embodiment

Figure 7:
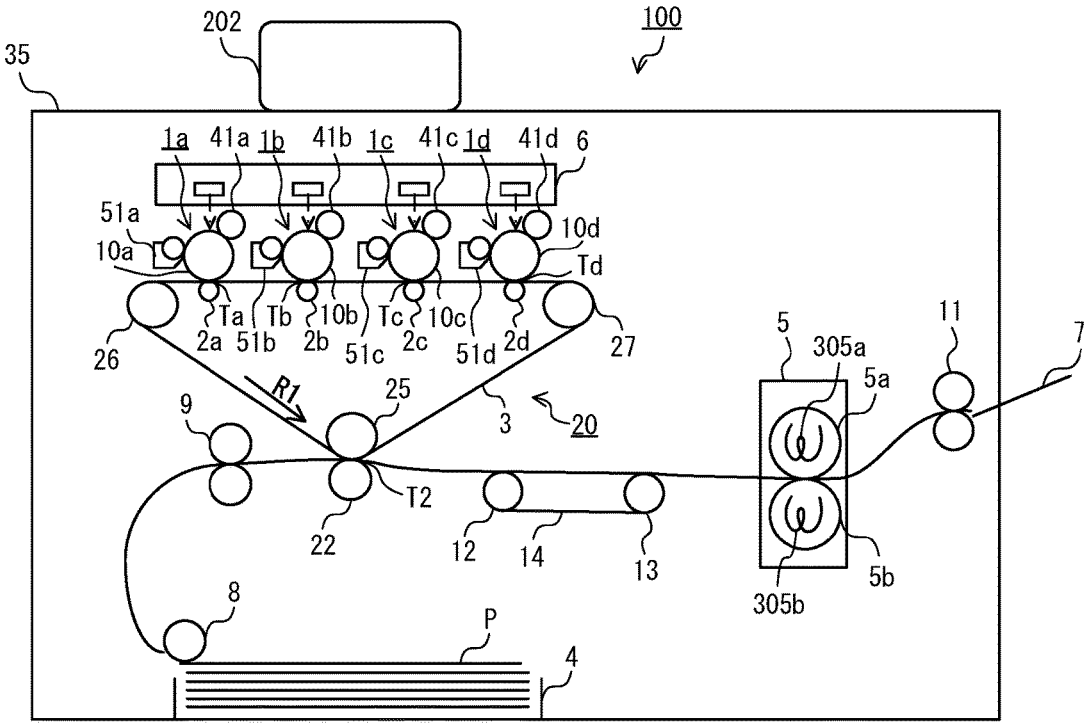
FIG. 7 is a diagram of a configuration of an image forming apparatus according to a third embodiment of the present disclosure.

FIG. 7 is a diagram of a configuration of an image forming apparatus according to a third embodiment of the present disclosure. The image forming apparatus 100 of the third embodiment has a configuration in which the casing of the main body 30 and the casing of the fixing apparatus 300 of the image forming apparatus 100 of the first embodiment are integrated into one. That is, a main body 35 of the image forming apparatus 100 according to the third embodiment includes the configuration and function of the main body 30 of the image forming apparatus 100 according to the first embodiment as well as the configuration and function of the fixing apparatus 300 in the first embodiment. Processing in image forming (FIG. 5A and FIG. 5B) is the same as the one in the first embodiment.

In the main body 35 of the image forming apparatus 100, a toner image is transferred onto the recording material P in the secondary transfer area T2. The recording material P with the toner image formed thereon is processed by the fixing device 5 so that the toner image is fixed to the recording material P. The fixing device 5 has a configuration that is substantially the same as that of the fixing device 5 included in the fixing apparatus 300 in the first embodiment, but requires less power. Only one power source system is accordingly used. The recording material P to which the image has been fixed is delivered onto the delivery tray 7 from the fixing device 5 via the delivery rollers 11.

Figure 8:
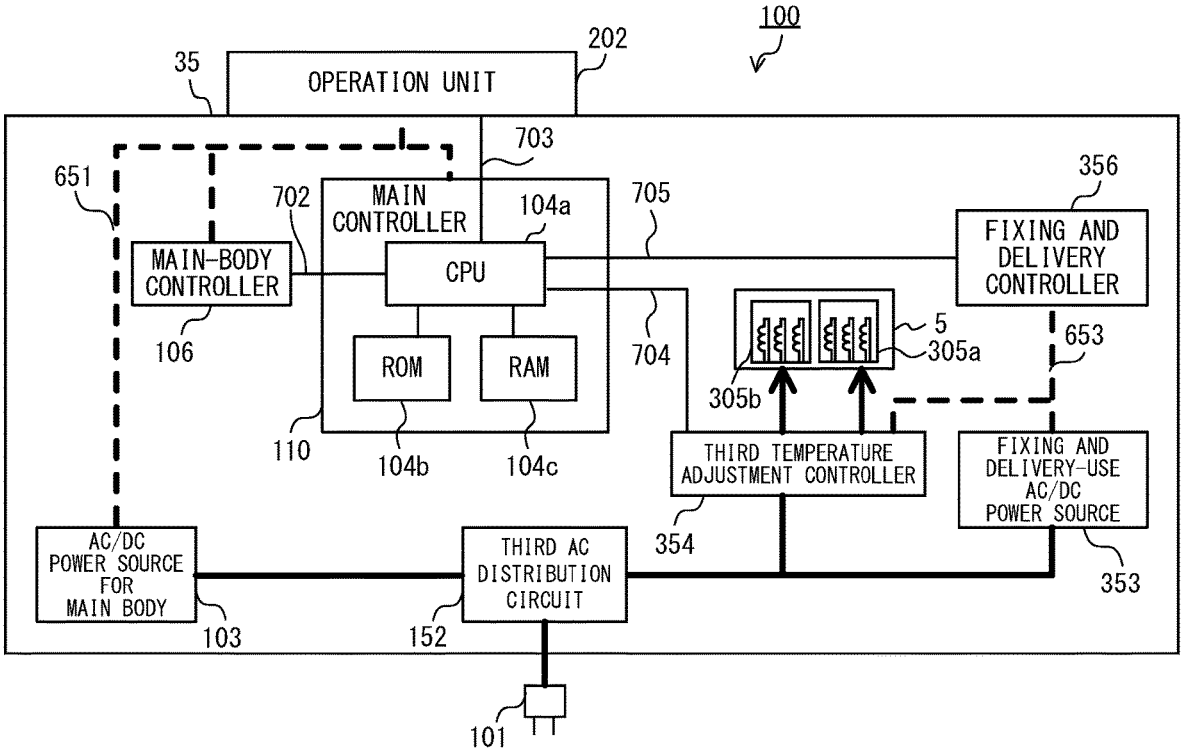
FIG. 8 is an explanatory diagram of a system configuration in the third embodiment.

FIG. 8 is an explanatory diagram of a system configuration of the image forming apparatus 100 according to the third embodiment. Each thick solid line represents a power feeding path (power feeding line) of AC power fed from a commercial power source. Each thick dotted line represents a power feeding path (power feeding line) of DC power generated from the commercial power source. Each thin line represents a signal line. Differences from the system configuration of the first embodiment that is illustrated in FIG. 2 are described.

The image forming apparatus 100 of the third embodiment has only the first AC input portion 101 as an input portion for a commercial power source. The second AC input portion 301 in the first embodiment is not required. The system configuration of the image forming apparatus 100 according to the third embodiment thus differs from the one in the first embodiment in the wiring of the power feeding line for AC power.

In the image forming apparatus 100, the main body 35 is connected to the commercial power source via the first AC input portion 101. The first AC input portion 101 in the drawing has one power line for the purpose of simplifying the description, but the number of power lines is not limited thereto. A third AC distribution circuit 152, the AC/DC power source 103 for the main body, the main-body controller 106, the main controller 110, a fixing and delivery-use AC/DC power source 353, a third temperature adjustment controller 354, and a fixing and delivery controller 356 are provided inside the main body 35.

The commercial power source supplies AC power to the third AC distribution circuit 152 via the first AC input portion 101. The third AC distribution circuit 152 distributes the supplied AC power among the AC/DC power source 103 for the main body, the third temperature adjustment controller 354, and the fixing and delivery-use AC/DC power source 353. The fixing and delivery-use AC/DC power source 353 has the same function as that of the AC/DC power source 303 for the fixing apparatus in the first embodiment. The fixing and delivery controller 356 has the same function as that of the fixing apparatus controller 306 in the first embodiment.

Figure 9:
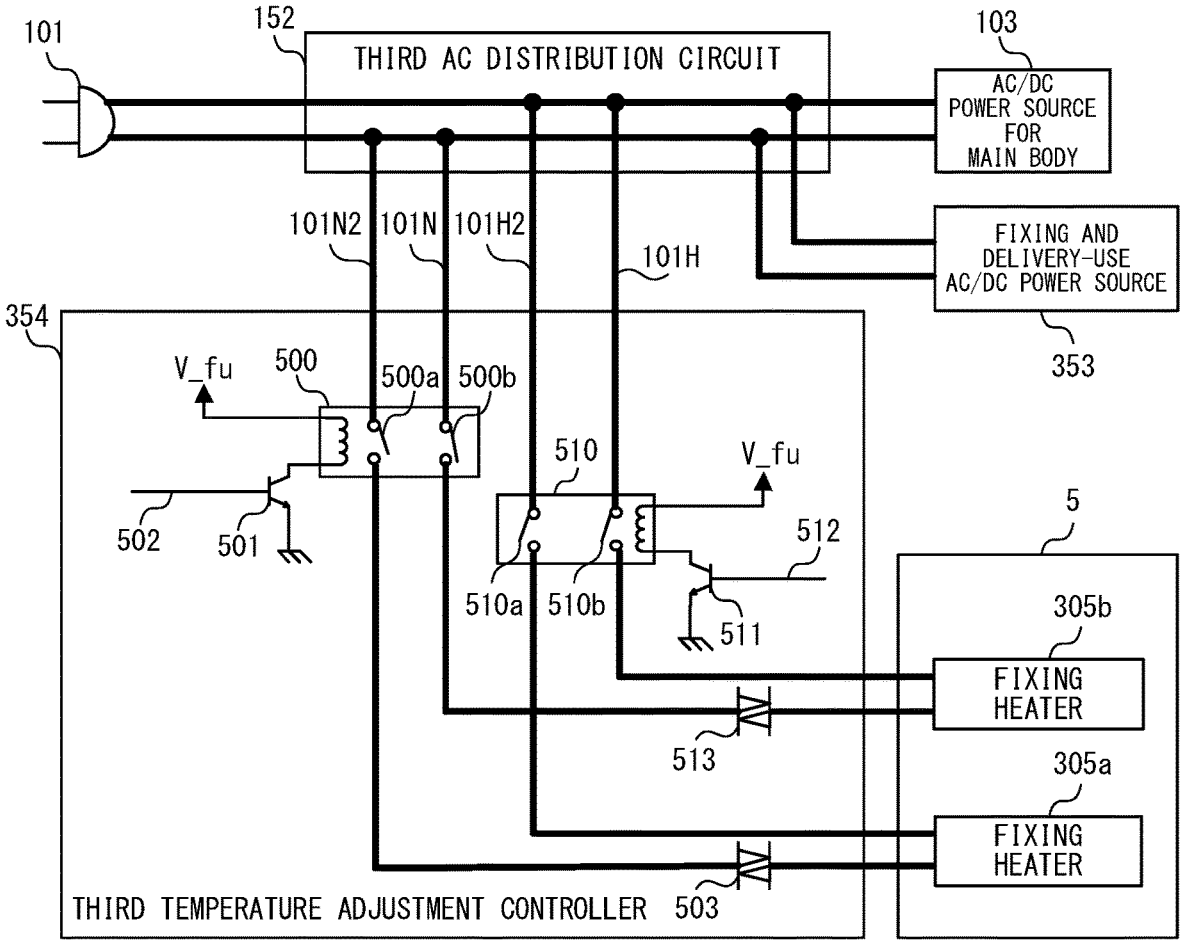
FIG. 9 is an explanatory diagram of a configuration of a third temperature adjustment controller.

FIG. 9 is an explanatory diagram of a configuration of the third temperature adjustment controller 354. The third temperature adjustment controller 354 has the same internal configuration as that of the first temperature adjustment controller 304 in the first embodiment, but differs from the first temperature adjustment controller 304 in which polarity of AC power is connected to which contact out of the contacts of the first relay 500 and the second relay 510. The difference from the first embodiment is described.

As described above, the third AC distribution circuit 152 distributes AC power among the AC/DC power source 103 for the main body, the third temperature adjustment controller 354, and the fixing and delivery-use AC/DC power source 353. The third temperature adjustment controller 354 is connected, via the third AC distribution circuit 152, to hot power feeding lines 101H and 101H2 as well as neutral power feeding lines 101N and 101N2 of the first AC input portion 101. This is a configuration adapted to a rated current of a connector and an electric wire which are used for wire connection between the third AC distribution circuit 152 and the third temperature adjustment controller 354. In a case where the connector and the electric wire satisfy the rated current, a configuration in which one hot power feeding line and one neutral power feeding line are included, and AC power is distributed inside the third temperature adjustment controller 354 between the fixing heater 305*a* and the fixing heater 305*b* may be employed.

The first contact 500*a* of the first relay 500 is connected at one end to the neutral power feeding line 101N2. Another end of the first contact 500*a* of the first relay 500 is connected to the fixing heater 305*a*. The second contact 500*b* of the first relay 500 is connected at one end to the neutral power feeding line 101N. Another end of the second contact 500*b* of the first relay 500 is connected to the fixing heater 305*b*. The first contact 510*a* of the second relay 510 is connected at one end to the hot power feeding line 101H2.

Another end of the first contact 510*a* of the second relay 510 is connected to the fixing heater 305*a*. The second contact 510*b* of the second relay 510 is connected at one end to the hot power feeding line 101H. Another end of the second contact 510*b* of the second relay 510 is connected to the fixing heater 305*b*. The operation principle of the first relay 500 and the second relay 510 is the same as that of the first relay 500 and the second relay 510 of the first temperature adjustment controller 304.

The fixing heater 305*a* of the fixing device 5 is connected to the hot power feeding line 101H2 via the first contact 510*a* inside the third temperature adjustment controller 354. The fixing heater 305*a* is connected to the neutral power feeding line 101N2 via the first contact 500*a* and the triac 503 inside the third temperature adjustment controller 354. The fixing heater 305*b* of the fixing device 5 is connected to the hot power feeding line 101H via the second contact 510*b* inside the third temperature adjustment controller 354. The fixing heater 305*b* is connected to the neutral power feeding line 101N via the second contact 500*b* and the triac 513 inside the third temperature adjustment controller 354. The operation principle of the triacs 503 and 513 is the same as that of the triacs 503 and 513 of the first temperature adjustment controller 304.

The same effects as those of the first temperature adjustment controller 304 are obtained even when the third temperature adjustment controller 354 having the configuration described above is used.

In a case where temperature adjustment control by the triac 503 is not working and a short circuit between the emitter and the collector occurs in the first transistor 501, the third temperature adjustment controller 354 disconnects the first contact 510*a* of the second relay 510 with the control signal 512. The third temperature adjustment controller 354 shuts off the supply of AC power to the fixing heater 305*a* in this manner.

In a case where temperature adjustment control by the triac 503 is not working and a short circuit between the emitter and the collector occurs in the second transistor 511, the third temperature adjustment controller 354 disconnects the first contact 500*a* of the first relay 500 with the control signal 502. The third temperature adjustment controller 354 shuts off the supply of AC power to the fixing heater 305*a* in this manner.

In a case where temperature adjustment control by the triac 513 is not working and a short circuit between the emitter and the collector occurs in the second transistor 511, the third temperature adjustment controller 354 disconnects the second contact 500*b* of the first relay 500 with the control signal 502. The third temperature adjustment controller 354 shuts off the supply of AC power to the fixing heater 305*b* in this manner.

In a case where temperature adjustment control by the triac 513 is not working and a short circuit between the emitter and the collector occurs in the first transistor 501, the third temperature adjustment controller 354 disconnects the second contact 510*b* of the second relay 510 with the control signal 512. The third temperature adjustment controller 354 shuts off the supply of AC power to the fixing heater 305*b* in this manner.

Fourth Embodiment

Figure 10:
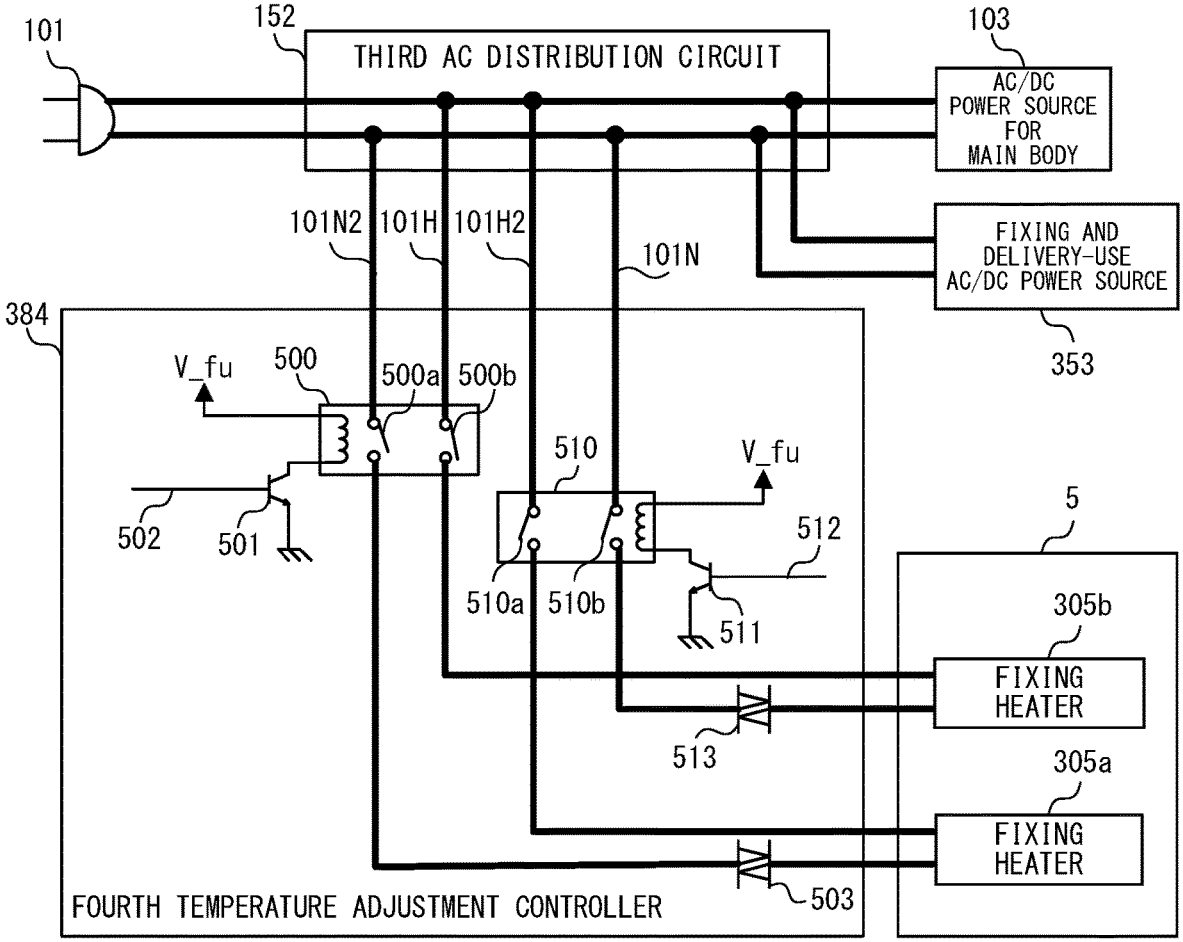
FIG. 10 is an explanatory diagram of a configuration of a fourth temperature adjustment controller.

In a fourth embodiment of the present disclosure, a fourth temperature adjustment controller is used in place of the third temperature adjustment controller 354 in the third embodiment. The rest of the configuration of the fourth embodiment (the configuration of the image forming apparatus 100 and the system configuration) is the same as that of the third embodiment illustrated in FIG. 7 and FIG. 8. Processing executed in image forming (FIG. 5A and FIG. 5B) in the fourth embodiment is the same as the one in the first embodiment. FIG. 10 is an explanatory diagram of a configuration of a fourth temperature adjustment controller 384. The difference from the third temperature adjustment controller 354 illustrated in FIG. 9 is described.

The first contact 500*a* of the first relay 500 is connected at one end to the neutral power feeding line 101N2. Another end of the first contact 500*a* of the first relay 500 is connected to the fixing heater 305*a*. The second contact 500*b* of the first relay 500 is connected at one end to the hot power feeding line 101H. Another end of the second contact 500*b* of the first relay 500 is connected to the fixing heater 305*b*. The first contact 510*a* of the second relay 510 is connected at one end to the hot power feeding line 101H2. Another end of the first contact 510*a* of the second relay 510 is connected to the fixing heater 305*a*. The second contact 510*b* of the second relay 510 is connected at one end to the neutral power feeding line 101N. Another end of the second contact 510*b* of the second relay 510 is connected to the fixing heater 305*b*. The operation principle of the first relay 500 and the second relay 510 is the same as that of the first relay 500 and the second relay 510 of the third temperature adjustment controller 354.

The fixing heater 305*a* of the fixing device 5 is connected to the hot power feeding line 101H2 via the first contact 510*a* inside the fourth temperature adjustment controller 384. The fixing heater 305*a* is connected to the neutral power feeding line 101N2 via the first contact 500*a* and the triac 503 inside the fourth temperature adjustment controller 384. The fixing heater 305*b* of the fixing device 5 is connected to the hot power feeding line 101H via the second contact 500*b* inside the fourth temperature adjustment controller 384. The fixing heater 305*b* is connected to the neutral power feeding line 101N via the second contact 510*b* and the triac 513 inside the fourth temperature adjustment controller 384.

The same effects as those of the first temperature adjustment controller 304 are obtained even when the fourth temperature adjustment controller 384 having the configuration described above is used.

In a case where temperature adjustment control by the triac 503 is not working and a short circuit between the emitter and the collector occurs in the first transistor 501, the fourth temperature adjustment controller 384 disconnects the first contact 510*a* of the second relay 510 with the control signal 512. The fourth temperature adjustment controller 384 shuts off the supply of AC power to the fixing heater 305*a* in this manner.

In a case where temperature adjustment control by the triac 503 is not working and a short circuit between the emitter and the collector occurs in the second transistor 511, the fourth temperature adjustment controller 384 disconnects the first contact 500*a* of the first relay 500 with the control signal 502. The fourth temperature adjustment controller 384 shuts off the supply of AC power to the fixing heater 305*a* in this manner.

In a case where temperature adjustment control by the triac 513 is not working and a short circuit between the emitter and the collector occurs in the second transistor 511, the fourth temperature adjustment controller 384 disconnects the second contact 500*b* of the first relay 500 with the control signal 502. The fourth temperature adjustment controller 384 shuts off the supply of AC power to the fixing heater 305*b* in this manner.

In a case where temperature adjustment control by the triac 513 is not working and a short circuit between the emitter and the collector occurs in the first transistor 501, the fourth temperature adjustment controller 384 disconnects the second contact 510*b* of the second relay 510 with the control signal 512. The fourth temperature adjustment controller 384 shuts off the supply of AC power to the fixing heater 305*b* in this manner.

In the image forming apparatus 100 of each of the embodiments described above, the feeding of AC power to a plurality of fixing heaters is controlled by the first temperature adjustment controller 304, the second temperature adjustment controller 334, the third temperature adjustment controller 354, or the fourth temperature adjustment controller 384, which includes a plurality of relays each including a plurality of contacts. A hot power feeding line of AC power and a neutral power feeding line of AC power are connected to one fixing heater via different relays. That is, one fixing heater is connected to a hot terminal and neutral terminal of a commercial power source via different relays. The contacts of one relay are connected to different fixing heaters. With this configuration, even when a failure occurs in one of the relays connected to one fixing heater and disconnection of the relay is consequently not possible, power feeding to the fixing heater can be shut off by disconnecting another of the relays. The fixing heater can therefore be prevented from reaching an abnormal temperature despite the failure in one of the relays.

The triacs 503 and 513, which are connected to neutral power feeding lines via relays in the embodiments described above, may be connected to hot power feeding lines.

As described above, according to the configuration of the present disclosure, it is possible to prevent abnormal heat generation of the fixing heaters in the event of the failure of the relay having the plurality of contacts.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-006854, filed Jan. 20, 2020, which is hereby incorporated by reference herein in its entirety.

What is claimed is:

1. An image forming apparatus comprising:

a first plug to which first AC power is supplied from a first AC power source;

a second plug to which second AC power is supplied from a second AC power source;

an image forming unit configured to form an image on a recording material;

a fixing device including a first heater which is configured to generate heat based on the first AC power and a second heater which is configured to generate heat based on the second AC power, the fixing device being configured to fix the image to the recording material by heating the image on the recording material with the first heater and the second heater;

a first power line for supplying the first AC power from the first plug to the first heater;

a second power line for supplying the second AC power from the second plug to the second heater;

a third power line for supplying the first AC power from the first plug to the first heater;

a fourth power line for supplying the second AC power from the second plug to the second heater;

a first relay, provided for the first power line and the second power line, configured to switch the first power line and the second power line between a first state in which electric connection is established and a second state in which electric connection is not established; and a second relay, provided for the third power line and the fourth power line, configured to switch the third power line and the fourth power line between a third state in which electric connection is established and a fourth state in which electric connection is not established.

2. The image forming apparatus according to claim 1, wherein the first power line is a first neutral power line of the first plug, wherein the second power line is a second neutral power line of the second plug wherein the third power line is a first hot power line of the first plug, and wherein the fourth power line is a second hot power line of the second plug.

3. The image forming apparatus according to claim 1, wherein the first power line is a first neutral power line of the first plug, wherein the third power line is a first hot power line of the first plug, wherein the second power line is a second hot power line of the second plug, wherein the fourth power line is a second neutral power line of the second plug.

4. The image forming apparatus according to claim 1, further comprising:

a first drive circuit configured to supply a drive current to the first relay, the first relay being switched between the first state and the second state depending based on the drive current supplied from the first drive circuit;

a second drive circuit configured to supply a drive current to the second relay, the second relay being switched between the third state and the fourth state based on the drive current supplied from the second drive circuit; and a controller configured to control the first drive circuit and the second drive circuit, wherein the controller is configured to control the second relay in the fourth state with use of the second drive circuit in a case where the first relay is not controlled in the second state with use of the first drive circuit, and to disconnect the first relay with the use of the first drive circuit in a case where the second relay is not disconnectable with the use of the second drive circuit.

5. The image forming apparatus according to claim 4, wherein the controller is configured to control the first relay in the second state with use of the first drive circuit in a case where the second relay is not controlled in the fourth state with use of the second drive circuit.

6. The image forming apparatus according to claim 4, further comprising:

a first triac provided between the first heater and the first relay at the first power line; and a second triac provided between the second heater and the first relay at the second power line, wherein the controller is configured to control, in a state where the electric connections are established by the first relay and the second relay, the first triac to supply the first AC power to the first heater, and wherein the controller is configured to control, in a state where the electric connections are established by the first relay and the second relay, the second triac to supply the second AC power to the second heater.

7. The image forming apparatus according to claim 4, further comprising:

a first triac provided between the first heater and the first relay at the first power line; and a second triac provided between the second heater and the second relay at the fourth power line, wherein the controller is configured to control, in a state where the electric connections are established by the first relay and the second relay, the first triac to supply the first AC power to the first heater, and wherein the controller is configured to control, in a state where the electric connections are established by the first relay and the second relay, the second triac to supply the second AC power to the second heater.

8. The image forming apparatus according to claim 1, further comprising:

a first drive circuit configured to supply a drive current to the first relay, the first relay being switched between the first state and the second state based on the drive current supplied from the first drive circuit;

a second drive circuit configured to supply a drive current to the second relay, the second relay being switched between the third state and the fourth state based on the drive current supplied from the second drive circuit; and a controller configured to control the first drive circuit and the second drive circuit.

9. A heater control device comprising:

a first heater;

a second heater;

a plug to which AC power is supplied from an AC power source;

a controller configured to control heat generation of the first heater based on the AC power, receive another AC power supplied from another AC power source by using another plug, and control heat generation of the second heater based on the another AC power;

a first power line for supplying the AC power to the first heater;

a second power line for supplying the another AC power to the second heater;

a third power line for supplying the AC power to the first heater;

a fourth power line for supplying the another AC power to the second heater;

a first relay, provided for the first power line and the second power line, configured to switch the first power line and the second power line between a first state in which electric connection is established and a second state in which electric connection is not established; and a second relay, provided for the third power line and the fourth power line, configured to switch the third power line and the fourth power line between a third state in which electric connection is established and a fourth state in which electric connection is not established.

* * * * *